US009258665B2

(12) United States Patent
Whitley

(10) Patent No.: US 9,258,665 B2
(45) Date of Patent: Feb. 9, 2016

(54) APPARATUS, SYSTEMS AND METHODS FOR CONTROLLABLE SOUND REGIONS IN A MEDIA ROOM

(75) Inventor: Samuel Whitley, Cheyenne, WY (US)

(73) Assignee: EchoStar Technologies L.L.C., Englewood, CO (US)

( * ) Notice: Subject to any disclaimer, the term of this patent is extended or adjusted under 35 U.S.C. 154(b) by 802 days.

(21) Appl. No.: 13/007,410

(22) Filed: Jan. 14, 2011

(65) Prior Publication Data

US 2012/0185769 A1 Jul. 19, 2012

(51) Int. Cl.
*H04S 7/00* (2006.01)
*H04H 60/04* (2008.01)

(52) U.S. Cl.
CPC ..... *H04S 7/303* (2013.01); *H04H 60/04* (2013.01); *H04R 2203/12* (2013.01); *H04S 2400/13* (2013.01); *H04S 2420/01* (2013.01)

(58) Field of Classification Search
CPC ..... H04S 3/008; H04S 7/302; H04S 7/303; G10K 11/34; G10K 11/341
USPC ..... 381/99, 17, 18, 300, 303, 305, 306
See application file for complete search history.

(56) References Cited

U.S. PATENT DOCUMENTS

| | | | | |
|---|---|---|---|---|
| 8,433,085 | B2 * | 4/2013 | Mizuno et al. | 381/306 |
| 2002/0013698 | A1 | 1/2002 | Vaudrey et al. | |
| 2003/0014486 | A1 * | 1/2003 | May | 381/77 |
| 2003/0059067 | A1 | 3/2003 | Shibata | |
| 2004/0105550 | A1 * | 6/2004 | Aylward | H04S 3/00 381/17 |
| 2005/0078840 | A1 * | 4/2005 | Riedl | 381/104 |
| 2005/0117762 | A1 * | 6/2005 | Sakurai et al. | 381/309 |
| 2006/0008117 | A1 | 1/2006 | Kanada | |
| 2006/0262935 | A1 | 11/2006 | Goose et al. | |
| 2009/0034745 | A1 * | 2/2009 | Mizuno | 381/1 |
| 2009/0290724 | A1 * | 11/2009 | Corynen et al. | 381/99 |
| 2010/0034403 | A1 * | 2/2010 | Mizuno et al. | 381/306 |

FOREIGN PATENT DOCUMENTS

| | | | |
|---|---|---|---|
| EP | 0932324 | A2 | 7/1999 |
| EP | 1850640 | A1 | 10/2007 |
| EP | 1901583 | A1 | 3/2008 |

* cited by examiner

*Primary Examiner* — Ping Lee
(74) *Attorney, Agent, or Firm* — Lowe Graham Jones PLLC

(57) ABSTRACT

Systems and methods are operable to present audio content of a received media content stream in a plurality of user controllable spot focused sound regions. An exemplary embodiment receives an audio content stream comprising at least a first audio channel and a second audio channel; multiplies the first audio channel into a plurality of first audio channels, multiplies the second audio channel into a plurality of second audio channels; communicates a first one of the multiplied plurality of first audio channels and a first one of the multiplied plurality of second audio channels to a first audio sound region controller; and communicates a second one of the multiplied plurality of first audio channels and a second one of the multiplied plurality of second audio channels to a second audio sound region controller.

14 Claims, 5 Drawing Sheets

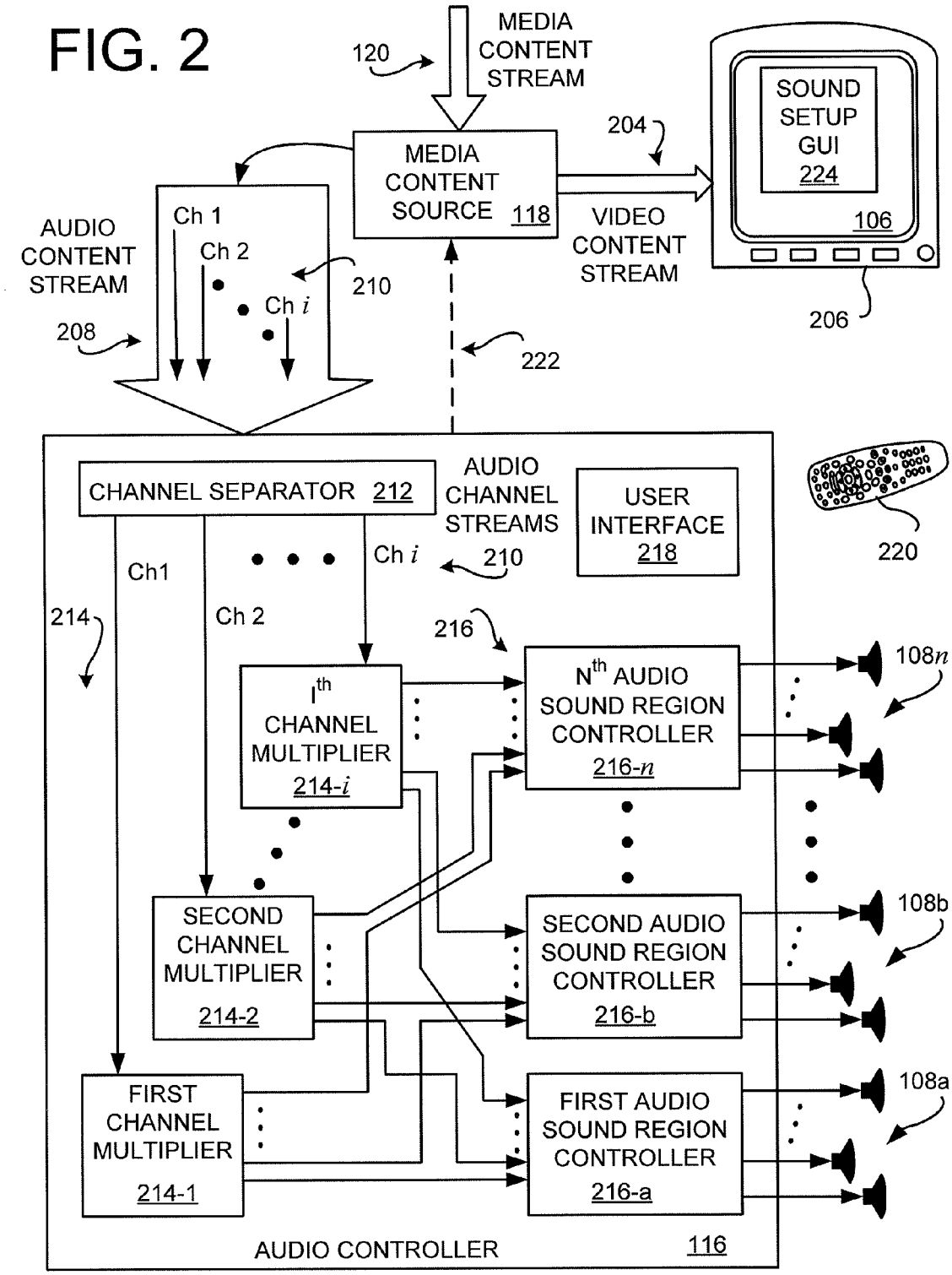
FIG. 2
120
MEDIA CONTENT STREAM
MEDIA CONTENT SOURCE 118
204
SOUND SETUP GUI 224
106
VIDEO CONTENT STREAM
206
AUDIO CONTENT STREAM
Ch 1
Ch 2
Ch i
210
208
222
CHANNEL SEPARATOR 212
AUDIO CHANNEL STREAMS
USER INTERFACE 218
220
Ch1
Ch 2
Ch i
210
214
216
I th CHANNEL MULTIPLIER 214-i
N th AUDIO SOUND REGION CONTROLLER 216-n
108n
SECOND CHANNEL MULTIPLIER 214-2
SECOND AUDIO SOUND REGION CONTROLLER 216-b
108b
FIRST CHANNEL MULTIPLIER 214-1
FIRST AUDIO SOUND REGION CONTROLLER 216-a
108a
AUDIO CONTROLLER
116

APPARATUS, SYSTEMS AND METHODS FOR CONTROLLABLE SOUND REGIONS IN A MEDIA ROOM

BACKGROUND

Media systems are configured to present media content that includes multiple audio channels. The sound from the media content is reproduced using a high-fidelity sound system that employs a plurality of speakers and other audio signal conditioning and/or reproducing components. Exemplary multiple channel audio content formats include the Dolby Digital formats, the Tomlinson Holman's experiment (THX) format, or the like. Exemplary media systems may include components such as a set top box, a stereo, a television (TV), a computer system, a game system, a digital video disk (DVD) player, surround sound systems, equalizers, or the like.

However, such media systems are limited to optimizing the audio sound for one best location or area of a media room where the user views and listens to the presented media content. This optimal area may be referred to as the "sweet spot" in the media room. For example, the sweet spot with the best sound in the media room may be located several feet back, and directly in line with, the display or TV screen. The speakers of the high-fidelity sound system are oriented and located such that they cooperatively reproduce the audio content in an optimal manner for the user when they are located in the sweet spot of the media room.

However, those users sitting outside of the sweet spot of the media room (to either side of, in front of, or behind the sweet spot) will hear less than optimal sound. For example, the center channel speaker and/or the front speakers that are oriented towards the sweet spot will not be oriented towards such users, and accordingly, will not provide the intended sound quality and sound levels to those users outside of the sweet spot of the media room. The rear speakers of a surround sound system will also not be directly behind and/or evenly separated behind the users that are outside of the sweet spot.

Further, different users perceive sound differently, and/or may have different personal preferences. That is, the presented audio sound of the media content that is configured for optimum enjoyment of one user may not be optionally configured for another user. For example, a hearing impaired user will hear sounds differently than a non-hearing impaired user. The hearing impaired user may prefer a lower presentation level of music and background sounds, and a higher volume level of the dialogue, as compared to the non-hearing impaired user. Young adults may prefer louder music and/or special effect sounds like explosions. In contrast, an elderly user may prefer a very low level of background music and/or special effect sounds so that they may better enjoy the dialogue of the media content.

Accordingly, there is a need in the arts to provide a more enjoyable audio content presentation for all users in the media room regardless of where they may be sitting and/or regardless of their personal preferences.

SUMMARY

Systems and methods of presenting audio content of a received media content stream in a plurality of user controllable spot focused sound regions are disclosed. An exemplary embodiment receives an audio content stream comprising at least a first audio channel and a second audio channel; multiplies the first audio channel into a plurality of first audio channels, multiplies the second audio channel into a plurality of second audio channels; communicates a first one of the multiplied plurality of first audio channels and a first one of the multiplied plurality of second audio channels to a first audio sound region controller; and communicates a second one of the multiplied plurality of first audio channels and a second one of the multiplied plurality of second audio channels to a second audio sound region controller.

BRIEF DESCRIPTION OF THE DRAWINGS

Preferred and alternative embodiments are described in detail below with reference to the following drawings:

FIG. 2 is a block diagram of an embodiment of the controllable high-fidelity sound system;

DETAILED DESCRIPTION

Figure 1:
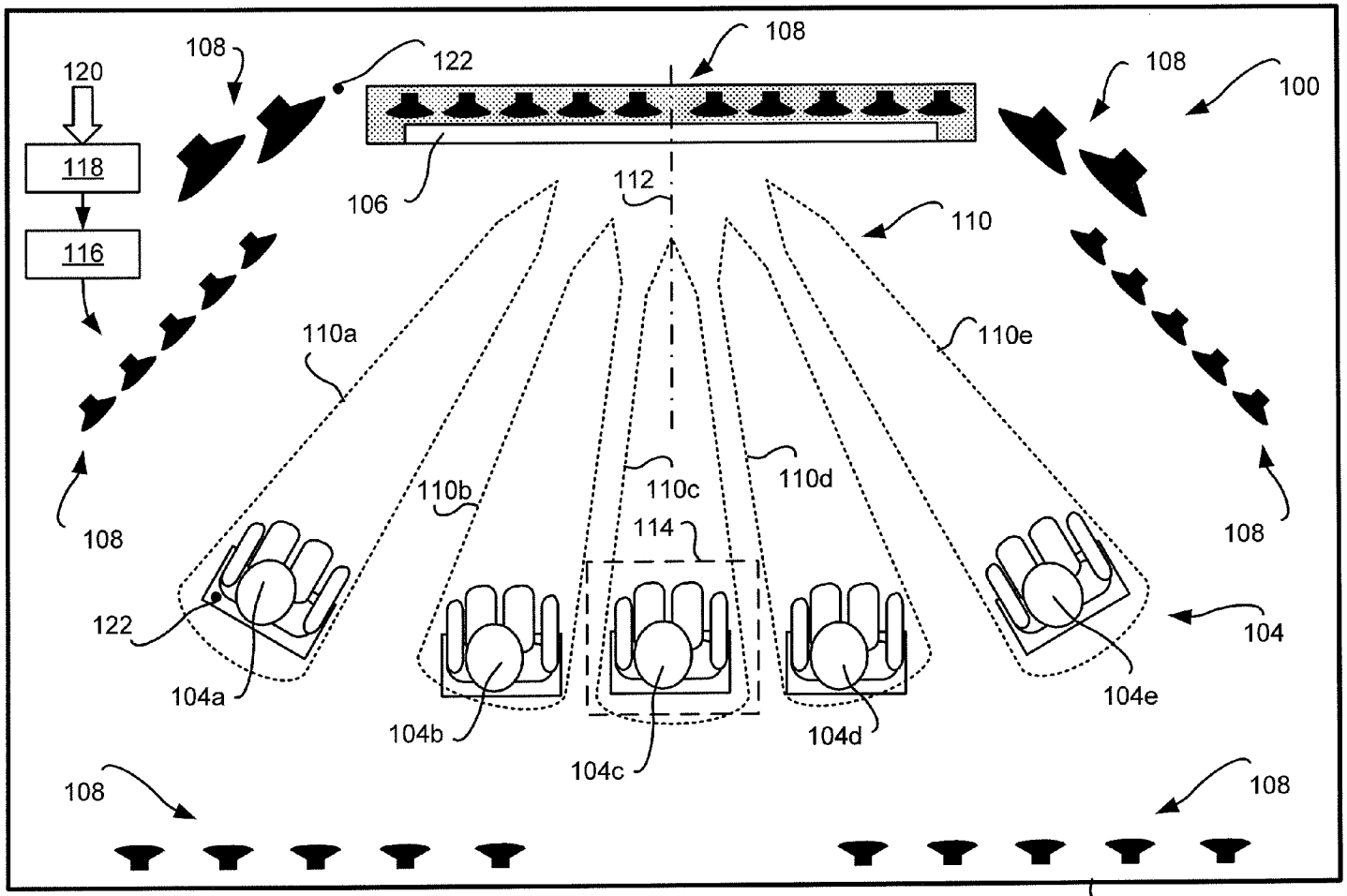
FIG. 1 is a diagram of an embodiment of a controllable high-fidelity sound system implemented in a media room.

FIG. 1 is a diagram of an embodiment of a controllable high-fidelity sound system 100 implemented in a media room 102. A plurality of users 104*a*-104*e* are illustrated as sitting and viewing a video portion of presented media content on a display 106, such as a television, a monitor, a projector screen, or the like. The users 104*a*-104*e* are also listening to the presented audio portion of the media content.

Embodiments of the controllable high-fidelity sound system 100 are configured to control output of a plurality of sound reproducing elements 108, generically referred to as speakers, of the controllable high-fidelity sound system 100. The sound reproducing elements 108 are adjusted to controllably provide presentation of the audio portion to each user. That is, the controllable high-fidelity sound system 100 is configured to generate a plurality of spot focused sound regions 110, with each one of the spot focused sound regions 110*a*-110*e* configured to generate a "sweet spot" for each of the users 104*a*-104*e*, respectively.

Each particular one of the spot focused sound regions 110 correspond to a region in the media room 102 where a plurality of sound reproducing elements 108 are configured to reproduce sounds that are focused to the intended region of the media room 102. To generate a spot focused sound region 110, selected ones of the sound reproducing elements 108 may be arranged in an array or the like so that sounds emitted by those sound reproducing elements 108 are directed towards and heard by the user located within that spot focused sound region 110. Further, the sounds generated for one particular spot focused sound region 110 may not be substantially heard by those users who are located outside of that spot focused sound region 110.

In the various embodiments, each particular plurality of selected ones of the sound reproducing elements 108 associated with one of the spot focused sound regions 110 are controllably adjustable based on the sound preferences of the user hearing sound from that particular spot focused sound region. Additionally, or alternatively, the sound reproducing elements 108 are automatically adjustable by the controllable high-fidelity sound system 100 based on system settings and/or detected audio characteristics of the received audio content.

For example, the user 104*c* is sitting in front of, and in alignment with, a center line 112 of the display 106. When the user 104*c* is located at a particular distance away from the display 106, the user 104*c* will be located in a sweet spot 114 of the media room 102 generated by the spot focused sound region 110*c*.

In contrast, the user 104*a* is located to the far left of the sweet spot 114 of the media room 102, and is not substantially hearing the presented audio content generated by the spot focused sound region 110*c*. Rather, the user 104*a* is hearing the presented audio content at the spot focused sound region 110*a*. Further, the user 104*a* is able to controllably adjust the sound within the spot focused sound region 110*a* for their particular personal preferences.

Embodiments of the controllable high-fidelity sound system 100 comprise a plurality of sound reproducing elements 108 and an audio controller 116. The audio controller 116 is configured to receive a media content stream 120 from a media content source 118. The media content stream 120 comprises at least a video stream portion and an audio stream portion. The video stream portion is processed to generate images that are presented on the display 106. The video stream may be processed by either the media content source 118 or other electronic devices.

In an exemplary system, the media content source 118 receives a media content stream 120 from one or more sources. For example, the media content stream 120 may be received from a media content distribution system, such as a satellite-based media content distribution system, a cable-based media content distribution system, an over-the-air media content distribution system, the Internet, or the like. In other situations, the media content stream 120 may be received from a digital video disk (DVD) system, an external memory medium, or an image capture device such as a camcorder or the like. The media content stream 120 may also be saved into a digital video recorder (DVR) or other memory medium residing in the media content source 118, which is later retrieved for presentation.

The audio stream portion is communicated from the media content source 118 to the audio controller 116. The audio controller 116 is configured to process the audio stream portion and is configured to control audio output of the plurality of sound reproducing elements 108. Groups of the sound reproducing elements 108 work in concert to produce sounds that create the individual spot focused sound regions 110. In some embodiments, the audio controller 116 is implemented with, or as a component of, the media content source 118 or another electronic device.

In an exemplary embodiment, the audio controller 116 has an a priori knowledge of the number and location of the exemplary five users 104*a*-104*e*. Embodiments may be configured to create any suitable number of spot focused sound regions 110. Accordingly, the generated spot focused sound regions 110 may be configured to correspond to the number of users 104 in the media room 102.

Alternatively, or additionally, embodiments may be configured to create any number of spot focused sound regions 110 that correspond to the number of locations where each one of the users 104 are likely to be in the media room 102. In the exemplary embodiment illustrated in FIG. 1, the audio controller 116 has an a priori knowledge of the five locations in the media room of the users 104*a*-104*e*.

In some embodiments, the number of and orientation of the spot focused sound regions 110 may be adjusted based on the actual number of and actual location of the users 104 in the media room 102 at the time of presentation of the media content. For example, if the user 104*a* is not present in the media room 102, then the audio controller 116 does not generate the spot focused sound region 110*a*.

An exemplary embodiment is configured to detect the number of and/or location of users 104 in the media room 102 prior to, and/or during, presentation of the media content. One or more detectors 122 may be at seating locations in the media room 102. Exemplary detectors include, but are not limited to, pressure detectors, movement/position detectors, and/or temperature detectors. Alternatively, or additionally, one or more detectors 122 may be located remotely from the seating locations. For example, an infrared heat detectors or the like may be used to remotely detect a user 104. Output signals from the detectors 122 are communicated to the audio controller 116 so that a determination may be made regarding the number of, and/or location of, the users 104.

FIG. 2 is a block diagram of an embodiment of the controllable high-fidelity sound system 100. The exemplary embodiment comprises the audio controller 116 and a plurality of sound reproducing elements 108.

The media content source 118, in an exemplary embodiment, provides a video content stream 204 to a media presentation device, such as the exemplary television 206 having the display 106 that presents the video portion of the media content stream 120 to the users 104. The media content source 118 also provides an audio content stream 208 to the audio controller 116.

The audio content stream 208 comprises a plurality of discrete audio portions, referred to generically herein as audio channels 210. Each of the plurality of audio channels 210 includes audio content that is a portion of the audio content stream 208, and is configured to be communicated to one or more of the sound reproducing elements 108. The audio content of the different audio channels 210 is different from the audio content of other audio channels 210. When the audio content from the different audio channels 210 are synchronously presented by the sound reproducing elements 108, then the users 104 will hear the presented audio content stream 208 as intended by the originators of the media content stream 120.

For example, the audio content stream 208 may be provided in stereo, comprising two audio channels 210. A first audio channel (Ch 1) is intended to be produced as sounds by one or more of the sound reproducing elements 108 that are located to the right of the centerline 112 (FIG. 1) and in front of the users 104. A second audio channel (Ch 2) is intended to be produced as sounds by one or more of the sound reproducing elements 108 that are located to the left of the centerline 112 and in front of the users 104. When the media content stream 120 is processed by the audio controller 116 and is then communicated to the appropriate sound reproducing elements 108, the user hears the media content stream 120 in stereo.

In the various embodiments, the audio content stream 208 may comprise any number of audio channels 210. For example, an audio content stream 208 may be provided in a 5.1 surround sound format, where there are six different audio channels 210. For example, with the 5.1 surround sound format the first audio channel (Ch 1) and the second audio channel (Ch 2) are intended to be produced as sounds by one or more of the sound reproducing elements 108 that are located to the left of and to the right of, respectively, and in front of, a user 104. A third audio channel (Ch 3) is intended to be produced as sounds by one or more of the sound reproducing elements 108 that are located directly in front of the users 104 to output the dialogue portion of the audio content stream 208. A fourth audio channel (Ch 4) is intended to be produced as sounds by one or more of the sound reproducing elements 108 that are located to the left and behind the users 104. A fifth audio channel (Ch 5) is intended to be produced as sounds by one or more of the sound reproducing elements 108 that are located to the right and behind the users 104. A fifth audio channel (Ch 6) is a low or ultra-low frequency sound channel that is intended to be produced as sounds by one or more of the sound reproducing elements generally located in front of the users 104.

Other formats of the media content stream 120 having any number of audio channels 210 may be used. For example, a 6.1 format would employ seven different audio channels 210 and a 7.1 format would employ eight different audio channels 210. Embodiments of the audio controller 116 are configured to receive and process different audio content streams 208 that employ different formats.

Further, embodiments of the audio controller 116 may be configured to receive the audio content stream 208 from a plurality of different media content sources 118. For example, but not limited to, the audio controller 116 may be coupled to a digital video disk (DVD) player, a set top box, and/or a compact disk (CD) player.

The exemplary embodiment of the audio controller 116 comprises a channel separator 212, a plurality of channel multipliers 214, a plurality of audio sound region controllers 216, and an optional user interface 218. The channel multipliers 214 are configured to multiply each of the received audio channels 210 into a plurality of like multiplied audio channels 210. The multiplied audio channels 210 are communicated from the channel multipliers 214 to each of the audio sound region controllers 216. The audio sound region controllers 216 are configured to control one or more characteristics of its respective received audio channel 210. Characteristics of the audio channels 210 may be controlled in a predefined manner, or may be controlled in accordance with user preferences that are received at the user interface 218. The controlled audio channels 210 are then communicated to one or more of the sound reproducing elements 108.

For example, the channel separator 212 processes, separates or otherwise parses out the audio content stream 208 into its component audio channels 210 (Ch 1 through Ch i). Accordingly, the channel separator 212 is configured to receive the audio content stream 208 and separate the plurality of audio channels 210 of the audio content stream 208 such that the separated audio channels 210 may be separately communicated from the channel separator 212.

In some embodiments, the plurality of audio channels 210 may be digitally multiplexed together and communicated in a single content stream from the media content source 118 to the audio controller 116. In this scenario, the received digital audio content stream 208 is de-multiplexed into its component audio channels 210. Alternatively, or additionally, the one or more of the audio channels 210 may be received individually, and may even be received on different connectors.

The plurality of channel multipliers 214 each receive one of the audio channels 210. Each channel multiplier 214 multiplies, reproduces, or otherwise duplicates its respective audio channel 210 and then outputs the multiplied audio channels 210.

Each individual audio channel 210 is then communicated from the channel separator 212 to its respective channel multiplier 214. For example, the first audio channel (Ch 1) is communicated to the first channel multiplier 214-1, the second audio channel (Ch 2) is communicated to the second channel multiplier 214-2, and so on, until the last audio channel (Ch i) is communicated to the last channel multiplier **214-*i***.

In embodiments configured to receive different formats of the audio content stream 208 having different numbers of audio channels 210, some of the channel multipliers 214 may not receive and/or process an audio channel. For example, an exemplary audio controller 116 may have the capacity to process either a 5.1 format audio content stream 208 and a 7.1 format audio content stream 208. This exemplary embodiment would have eight channel multipliers 214. However, when processing the 5.1 format audio content stream 208, two of the channel multipliers 214 may not be used.

Each of the audio sound region controllers 216 receive one of the multiplied audio channels 210 from the channel multipliers 214. For example, the first audio sound controller 216-1 receives the first audio channel (Ch 1) from the first channel multiplier 214-1, receives the second audio channel (Ch 2) from the second channel multiplier 214-2, and so on, until the last audio channel (Ch i) is received from the last channel multiplier **214-*i***.

Each of the audio sound region controllers 216 processes the received multiplied audio channels 210 to condition the multiplied audio channels 210 into a signal that is communicated to and then reproduced by a particular one of the sound reproducing elements 108. When the group of sound reproducing elements 108 generate the spot focused sound region 110, the sound that is heard by a particular user 104 located in the spot focused sound region 110 is pleasing to that particular user 104. The audio channels 210 may be conditioned in a variety of manners by its respective audio sound region controller 216. For example, the volume of the audio channels 210 may be increased or decreased. In an exemplary situation, the volume may be adjusted based upon a volume level specified by a user 104. Or, the volume may be automatically adjusted based on information in the media content stream 120.

Additionally, or alternatively, a pitch or other frequency of the audio information in the audio channel 210 may be adjusted. Additionally, or alternatively, the audio information in the audio channel 210 may be filtered to attenuate selected frequencies of the audio channel 210.

Additionally, or alternatively, a phase of the audio information in the audio channel 210 (with respect to phase of another audio channel 210) may be adjusted. For example, but not limited to, a grouping of the sound reproducing elements 108 may be configured such that the sound reproducing elements 108 cooperatively act to cancel emitted sounds that fall outside of the spot focused sound region 110 associated with that particular group of sound reproducing elements 108.

Any suitable signal conditioning process or technique may be used by the audio sound region controllers 216 in the various embodiments to process and condition the audio channels 210.

After processing the received audio channels 210, each of the audio sound region controllers 216 communicate the processed audio channels 210 to respective ones of the plurality of sound reproducing elements 108 that have been configured to create one of the spot focused sound regions 110 that is heard by a user that is at a location in the media room 102 intended to be covered by that particular spot focused sound region 110. For example, the spot focused sound region **110*a* is intended to be heard by the user 104*a* (FIG. 1). Thus, the audio sound region controller 216-*a* is configured to provide the processed audio channels 210 to a plurality of sound reproducing elements 108***a* that are located about and oriented about the media room 102 so as to generate the spot focused sound region 110*a*.

The user interface 218 is configured to receive user input that adjusts the processing of the received audio channels 210 by an individual user 104 operating one of the audio sound region controllers 216. For example, the user 104*a* may be more interested in hearing the dialogue of a presented movie, which may be predominately incorporated into the first audio channel (Ch 1). Accordingly, the user 104*a* may provide input, for example using an exemplary remote control 220, to increase the output volume of the first audio channel (Ch 1) to emphasize the dialogue of the movie, and to decrease the output volume of the second audio channel (Ch 2) and the third audio channel (Ch 3). In contrast, the user 104*c* may be more interested in enjoying the special effect sounds of the movie, which may be predominately incorporated into the second audio channel (Ch 2) and the third audio channel (Ch 3). Accordingly, the user 104*c* may increase the output of the second audio channel (Ch 2) and the third audio channel (Ch 3) to emphasize the special sound effects of the movie.

Some embodiments of the audio controller 116 may be configured to communicate with the media content source 118 and/or the media presentation device 206. A backchannel connection 222, which may be wire-based or wireless, may communicate information that is used to present a sound setup graphical user interface (GUI) 224 to the users 104 in the media room 102. When a particular user wishes to adjust audio processing of a particular one of the audio sound region controllers 216, the sound setup GUI 224 may be generated and presented on the display 106. The sound setup GUI 224 may be configured to indicate the controlled and/or conditioned characteristics, and the current setting of each characteristic, of the various processed audio channels 210. The user 104 may interactively adjust the viewed controlled characteristics of the audio channels 210 as they prefer. An exemplary sound setup GUI 224 is configured to graphically indicate the location and/or orientation of each of the sound reproducing elements 108, and may optionally present graphical icons corresponding to one or more of the spot focused sound regions 110, to assist the user 104 in adjusting the characteristics of the audio channels 210 in accordance with their preferences.

For example, an orientation of and/or a location of at least one sound reproducing element 108 of a group of sound reproducing elements 108 may be detected by one or more of the detectors 122. Then, a recommendation is presented on the sound setup GUI 224 recommending an orientation change to the orientation of, and/or a location change to a location of, the sound reproducing element 108. The recommended orientation change and/or location change is based upon improving the sound quality of a spot focused sound region 110 in the media room 102 that is associated with the group of sound reproducing elements 108. For example, a recommendation may be presented to turn a particular sound reproducing element 108 a few degrees in a clockwise or counter clockwise direction, or to turn the sound reproducing element 108 to a specified angle or by a specified angle amount. As another example, a recommendation may be presented to move the sound reproducing element 108 a few inches in a specified direction. The recommendations are based upon a determined optimal orientation and/or location of the sound reproducing element 108 for generation of the associated spot focused sound region 110.

Figure 3:
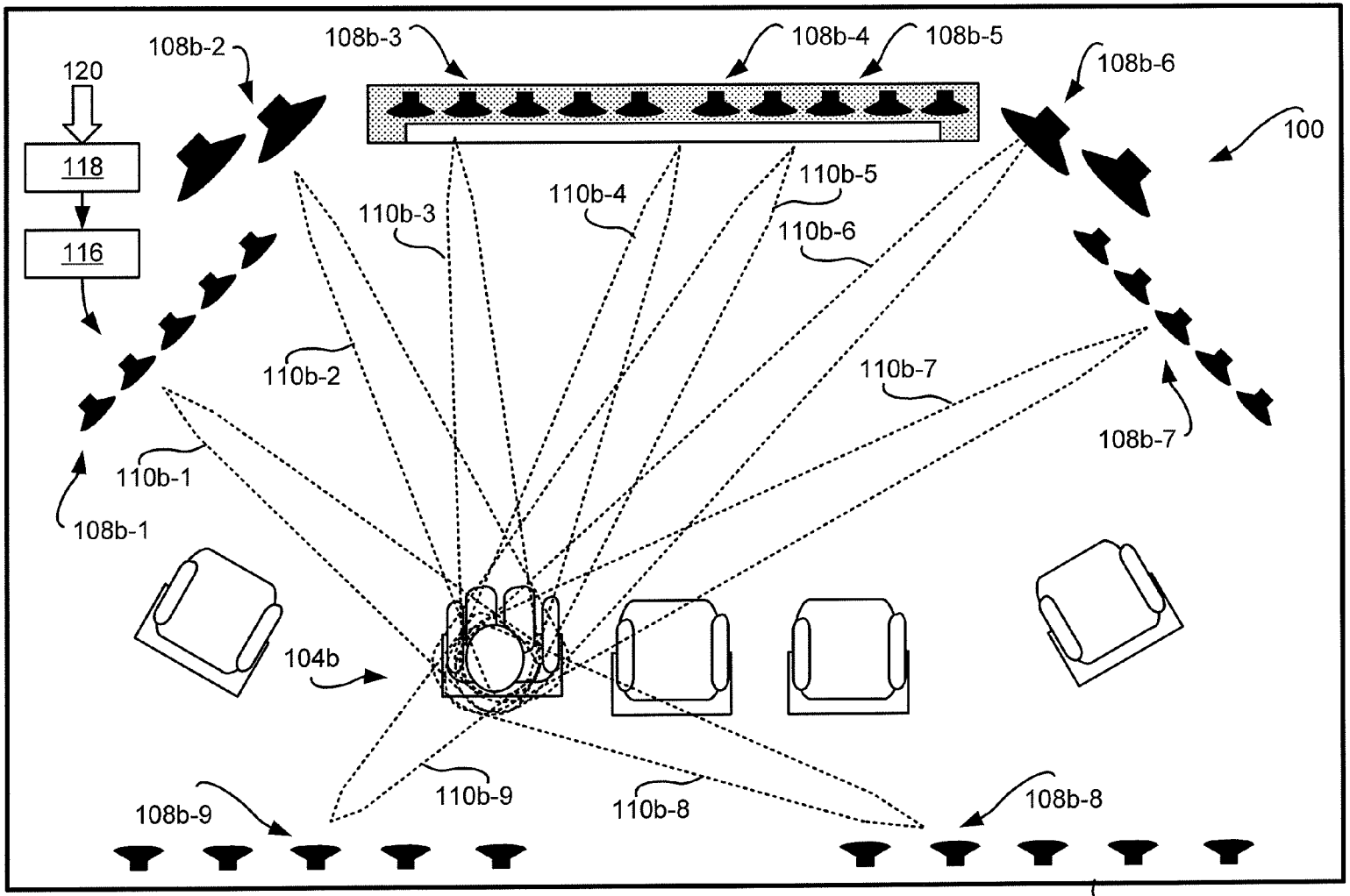
FIG. 3 conceptually illustrates an embodiment of the controllable high-fidelity sound system in a media room with respect to a single user.

FIG. 3 conceptually illustrates an embodiment of the controllable high-fidelity sound system 100 in a media room 102 with respect to a single user 104*a*. Here, a plurality of sound reproducing elements 108*b* are located about the media room and are generally oriented in the direction of the user 104*b*. In this example, the format of the received audio content stream 208 is formatted with at least nine audio channels 210. Thus, the audio sound region controller 216*b* is receiving nine audio channels 210 from nine channel multipliers 214 residing in the audio controller 116.

Each of the sound reproducing elements 108*b*-1 through 108*b*-9 each generate a respective sub-sound region 110*b*-1 through 110*b*-9. The generated sub-sound regions 110*b*-1 through 110*b*-9 cooperatively create the spot focused sound region 110*b* (FIG. 1). Similarly, other spot focused sound regions 110 are created by other groupings of selected ones of the sound reproducing elements 108 so that a plurality of spot focused sound regions 110 are created in the media room 102.

In this example embodiment, a first one (or more) of the sound reproducing elements 108*b*-1 may be uniquely controllable so as to generate a first sub-sound region 110*b*-1 based upon the first audio channel (Ch 1) output by the audio sound region controller 216-*b* (FIG. 2). Depending upon the system configuration, two, or even more than two, of the sound reproducing elements 108 may be coupled to the same channel output of the audio sound region controller 216*a* so that they cooperatively output sounds corresponding to the first audio channel (Ch 1).

In some embodiments, the audio sound region controllers 216 may optionally include an internal channel multiplier (not shown) so that a selected audio channel 210 can be separately generated, controlled, and communicated to different sound reproducing elements 108 that may be in different locations in the media room 102 and/or that may have different orientations. The audio channel 210 output from the audio sound region controllers 216 to a plurality of sound reproducing elements 108 may be individually controlled so as to improve the acoustic characteristics of the created spot focused sound region 110.

Similarly, a second one (or more) of the sound reproducing elements 108*b*-2 may be uniquely controllable so as to generate a second sub-sound region 110*b*-2. The audio sound region controller 216*b* controls the output audio signal that is communicated to the one or more sound reproducing elements 108*b*-2 that are intended to receive the second sound channel (Ch 2). The sub-sound regions 110*b*-3 through 110*b*-9 are similarly created.

In an exemplary embodiment, the user 104*b* may selectively control the audio sound region controller 216*b* to adjust acoustic characteristics of each of the sub-sound regions 110*b*-1 through 110*b*-9 in accordance with their personal listening preferences. The acoustic characteristics of the sub-sound regions 110*b*-3 through 110*b*-9 may be individually adjusted, adjusted as a group, or adjusted in accordance with predefined sub-groups or user defined sub-groups. That is, the output of the sound reproducing elements 108 may be adjusted by the user in any suitable manner.

Figure 4:
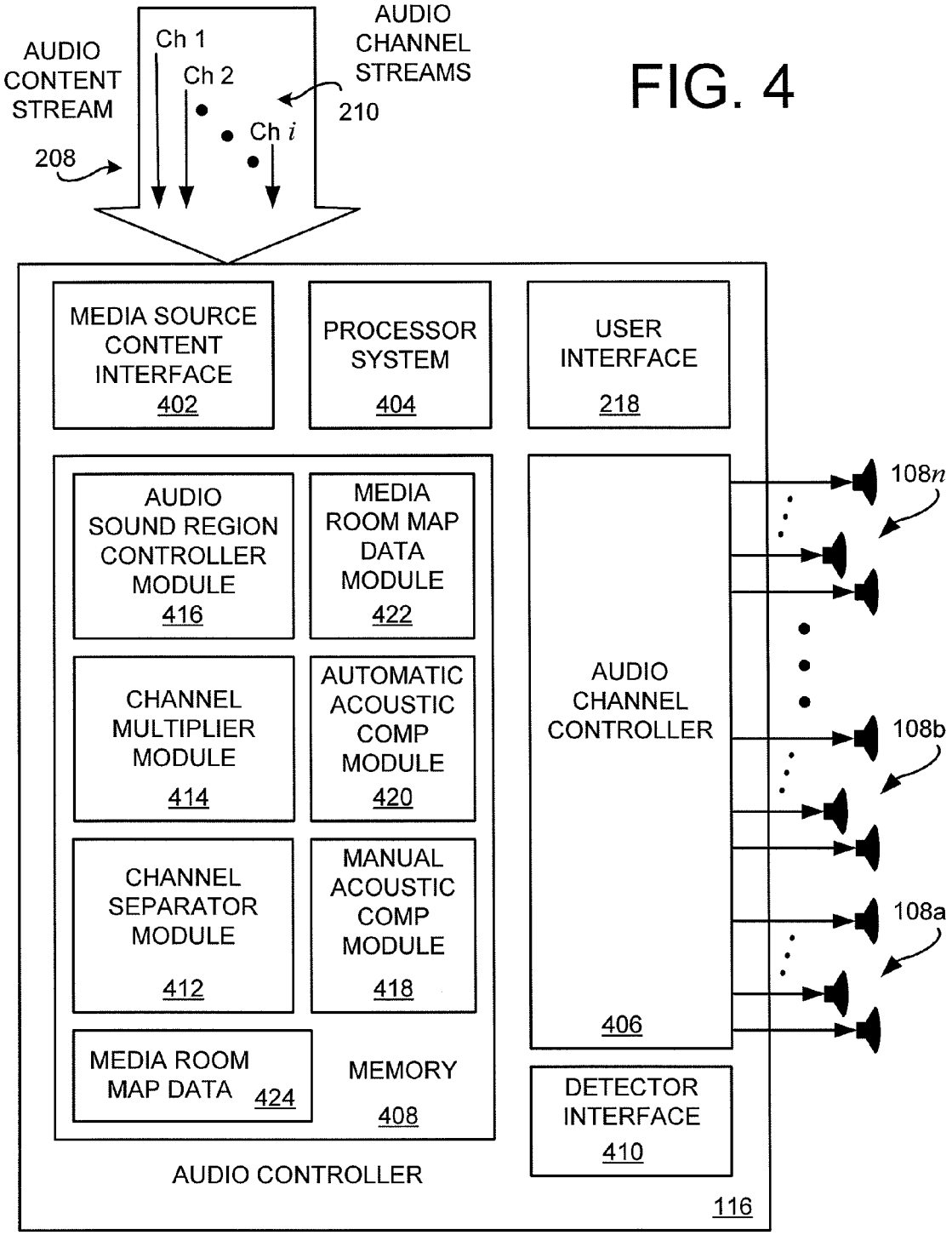
FIG. 4 is a block diagram of an embodiment of an exemplary audio controller of the controllable high-fidelity sound system.

FIG. 4 is a block diagram of an embodiment of an exemplary audio controller 116 of the controllable high-fidelity sound system 100. The exemplary audio controller 116 comprises the user interface 218, a media content interface 402, a processor system 404, an audio channel controller 406, a memory 408, and an optional detector interface 410. The memory 408 comprises portions for an optional channel separator module 412, an optional channel multiplier module 414, an optional audio sound region controller module 416, an optional manual acoustic compensation (comp) module 418, an optional automatic acoustic compensation module 420, an optional media room map data module 422, and an optional media room map data 424.

The media content interface 402 is configured to communicatively couple the audio controller 116 to one or more media content sources 118. The audio content stream 208 may be provided in a digital format and/or an analog format.

The processor system 404, executing one or more of the various modules 412, 414, 416, 418, 420, 422 retrieved from the memory 408, processes the audio content stream 208. The modules 412, 414, 416, 418, 420, 422 are described as separate modules in an exemplary embodiment. In other embodiments, one or more of the modules 412, 414, 416, 418, 420, 422 may be integrated together and/or may be integrated with other modules (not shown) having other functionality. Further, one or more of the modules 412, 414, 416, 418, 420, 422 may reside in another memory medium that is local to, or that is external to, the audio controller 116.

The channel separator module 412 comprises logic that electronically separates the received audio content stream 208 into its component audio channels 210. Thus, the channel separator module 412 electronically has the same, or similar, functionality as the channel separator 212 (FIG. 2). Alternatively, information corresponding to the component audio channels 210 may be made available on a communication bus (not shown) such that appropriate modules, the processor system 404, and/or the audio channel controller 406, may read or otherwise access the information for a particular component audio channel 210 as needed for processing and/or conditioning.

The channel multiplier module 414 comprises logic that electronically multiplies the component audio channels 210 so that of the audio channels 210 may be separately controllable. Thus, the channel multiplier module 414 electronically has the same, or similar, functionality as the channel multipliers 214 (FIG. 2). Alternatively, information corresponding to the component audio channels 210 may be made available on a communication bus (not shown) such that appropriate modules, the processor system 404, and/or the audio channel controller 406, may read or otherwise access the information for a particular component audio channel 210 as needed for processing and/or conditioning.

The audio sound region controller module 416 comprises logic that determines control parameters associated with the controllable acoustic characteristics the component audio channels 210. For example, but not limited to, a volume control parameter may be determined for one or more of the audio channels 210 based upon a user specified volume preference and/or based on automatic volume control information in the received media content stream 120. As another non-limiting example, the audio sound region controller module 416 may comprise logic that performs sound cancelling and/or phase shifting functions on the audio channels 210 for generation of a particular spot focused sound region 110. Thus, the audio sound region controller module 416 electronically has the same, or similar, functionality as the audio sound region controllers 216 (FIG. 2).

In operation the processor system 404 may execute at least one of the channel separator module 412 to separate the plurality of audio channels of the audio content stream 208, execute the channel multiplier module 414 to reproduce the received separated audio channel into a plurality of multiplied audio channels 210, and/or execute the audio sound region controller module 416 to determine an audio characteristic for each of the received multiplied audio channels 210.

The audio channel controller 406 conditions each of the received multiplied audio channels 210 based upon the audio characteristic determined by the processor system 404.

The user interface 218 receives user input so that the generated sound within any particular one of the spot focused sound regions 110 may be adjusted by the user 104 in accordance with their personal preferences. The user inputs are interpreted and/or processed by the manual acoustic compensation module 418 so that user acoustic control parameter information associated with the user preferences is determined.

In some situations, the acoustic characteristics of one or more of the audio channels 210 is automatically controllable based on automatic audio control parameters incorporated into the received audio content stream 208. Such control parameters may be specified by the producers of the media content. Alternatively, or additionally, some audio control parameters may be specified by other entities controlling the origination of the media content stream 120 and/or controlling communication of the media content stream 120 to the media content source.

In an exemplary embodiment, an automatic volume adjustment may be included in the media content stream 120 that specifies a volume adjustment for one or more of the audio content streams 208. For example, volume may be automatically adjusted during presentation of a relatively loud action scene, during presentation of a relatively quite dialogue scene, or during presentation of a musical score. As another example, a volume control change may be implemented for commercials or other advertisements. Such changes to the volume of the audio content may be made to the audio content stream 208, or may be made to one or more individual audio channels 210. Accordingly, the volume is readjusted in accordance with both the specified user volume level and the automatic volume adjustment.

The automatic acoustic compensation module 420 receives predefined audio characteristic input information from the received audio content stream 208, or another source, so that the generated sound within any particular one of the spot focused sound regions 110 may be automatically adjusted by the presented media content. That is, the automatic acoustic compensation module 420 determines the automatic acoustic control parameters associated with the presented media content.

The manual acoustic compensation module 418 and the automatic acoustic compensation module 420 cooperatively provide the determined user acoustic control parameters and the determined automatic acoustic control parameters, respectively, to the audio sound region controller module 416. The audio sound region controller module 416 then coordinates the received user acoustic control parameters and the automatic acoustic control parameters so that the acoustic characteristics of each individual audio channels 210 are individually controlled.

Information corresponding to the acoustic characteristics of each individual audio channel 210 determined by the audio sound region controller module 416 is communicated to the audio channel controller 406. The audio channel controller 406 is configured to communicatively couple to each of the sound reproducing elements 108 in the media room 102. Since each particular one of the sound reproducing elements 108 is associated with a particular one of the spot focused sound regions 110, and since each of the individual audio channels 210 are associated with a particular one of the spot focused sound regions 110 and the sound reproducing elements 108, the audio channel controller 406 generates an output signal that is communicated to each particular one of the sound reproducing elements 108 that has the intended acoustic control information. When the particular one of the sound reproducing elements 108 produces sound in accordance with the received output signal from the audio channel controller 406, the produced sound has the intended acoustic characteristics.

In the various embodiments, one or more detectors 122 (FIG. 1) may be located about the media room 102 to sense sound. The detectors 122, using a wireless signal or a wire-based signal, communicate information corresponding to the detected sound to the detector interface 410. The detector information is then provided to the automatic acoustic compensation module 420, or another module, so that automatic acoustic control parameters may be determined based upon the detected sounds detected by the detectors 122. For example, acoustic output from a rear left channel and a rear right channel sound reproducing elements 108 may need to be automatically adjusted during presentation to achieve an intended surround sound experience. Detectors 122 in proximity to theses sound reproducing elements 108 would detect sounds from the sound reproducing elements 108, provide the sound information as feedback to the automatic acoustic compensation module 420, and then the automatic acoustic compensation module 420 could adjust one or more of automatic acoustic control parameters for the selected audio channels 210 to achieve the intended acoustic effects.

Some embodiments include the media room map data module 422 and the media room map data 424. An exemplary embodiment may be configured to receive information that defines characteristics of the media room 102. The media room 102 characteristics are stored into the media room map data 424. For example, characteristics such as, but not limited to, the length and width of the media room may be provided. The user or a technician may input the characteristics of the media room 102. Some embodiments may be configured to receive acoustic information pertaining to acoustic characteristics of the media room 102, such as, but not limited to, characteristics of the wall, floor, and/or ceilings.

Further, location and orientation information of the sound reproducing elements 108 may be provided and stored into the media room map data 424. In some embodiments, the location and/or orientation information may be provided by the user or the technician. Alternatively, or additionally, detectors 122 may be attached to or included in one or more of the sound reproducing elements 108. Information from the detectors 122 may then be used to determine the location and/or orientation of the sound reproducing elements 108. Location information of the sound reproducing elements 108 may include both the plan location and the elevation information for the sound reproducing elements 108. Orientation refers to the direction that the sound reproducing element 108 is pointing in, and may include plan information, elevation angle information, azimuth information, or the like. The location information and the orientation information may be defined using any suitable system, such as a Cartesian coordinate system, a polar coordinate system, or the like.

Further, the number and location of the users 104 in the media room 102 may be input and stored. Accordingly, the audio controller 116 has a priori information of user location so that the spot focused sound regions 110 for each user 104 may be defined. In some embodiments, a plurality of different user location configurations may be used. Accordingly, a plurality of different spot focused sound regions 110 may be defined during media content presentation based upon the actual number of users present in the media room 102, and/or based on the actual location of the user(s) in the media room 102.

In an exemplary embodiment, the characteristics of the media room 102 and/or the location and/or orientation of the sound reproducing elements 108 in the media room 102 are input and saved during an initial set up procedure wherein the sound reproducing elements 108 are positioned and oriented about the media room 102 during initial installation of the controllable high-fidelity sound system 100. The stored information may be adjusted as needed, such as when the user rearranges seating in the media room 102 and/or changes the location and/or orientation of one or more of the sound reproducing elements 108.

The sound setup GUI 224 may be used to manually input the information pertaining to the characteristics of the media room 102, location of the users 104, and/or the location and/or orientation of the sound reproducing elements 108. For example, but not limited to, a mapping function may be provided in the media room map data module 422 that causes presentation of a map of the media room 102.

An exemplary embodiment may make recommendations for the location and/or orientation of the sound reproducing elements 108 during set up of media room 102. For example, the user may position and/or orient one of the sound reproducing elements 108 in a less that optimal position and/orientation. The media room map data module 422, based upon analysis of the input current location and/or current orientation of the sound reproducing element 108, based upon the input characteristics of the media room 102, based upon the input location of a user seating location in the media room 102, and/or based upon characteristics of the sound reproducing element 108 itself, may make a recommendation to the user 104 to adjust the location and/or orientation of the particular sound reproducing element 108. For example, the controllable high-fidelity sound system 100 may recommend a location and/or an orientation of a sub-woofer.

In some embodiments, recommendations for groupings of sound reproducing elements 108 may be made based upon the audio characteristics of individual sound reproducing elements 108. For example, a group of sound reproducing elements 108 may have one or more standard speakers for reproducing dialogue of the media content, a sub-woofer for special effects, and high frequency speakers for other special effects. Accordingly, the controllable high-fidelity sound system 100 may present a location layout recommendation of the selected types of sound reproducing elements 108 so that the plurality of sound reproducing elements 108, when controlled as a group, are configured to generate a pleasing spot focused sound region 110 at a particular location in the media room 102.

Embodiments may make such recommendations by presenting textual information and/or graphical information on the sound setup GUI 224 presented on the display 106. For example, graphical icons associated with particular one of the sound reproducing elements 108 may be illustrated in their recommended location and/or orientation about the media room 102.

Embodiments of the audio channel controller 406 may comprise a plurality of wire terminal connection points so that speaker wires coupled to the sound reproducing elements 108 can terminate at, and be connected to, the audio controller 116. The audio channel controller 406 may include suitable amplifiers so as to control the audio output signals that are communicated to its respective sound reproducing element 108.

Alternatively, or additionally, the sound reproducing elements 108 may be configured to wirelessly receive their audio output signals from the audio controller 116. Accordingly, a transceiver, a transmitter, or the like, may be included in the audio channel controller 406 to enable wireless communications between the audio controller 116 and the sound reproducing elements 108. Radio frequency (RF) and/or infrared (IR) wireless signals may be used.

Figure 5:
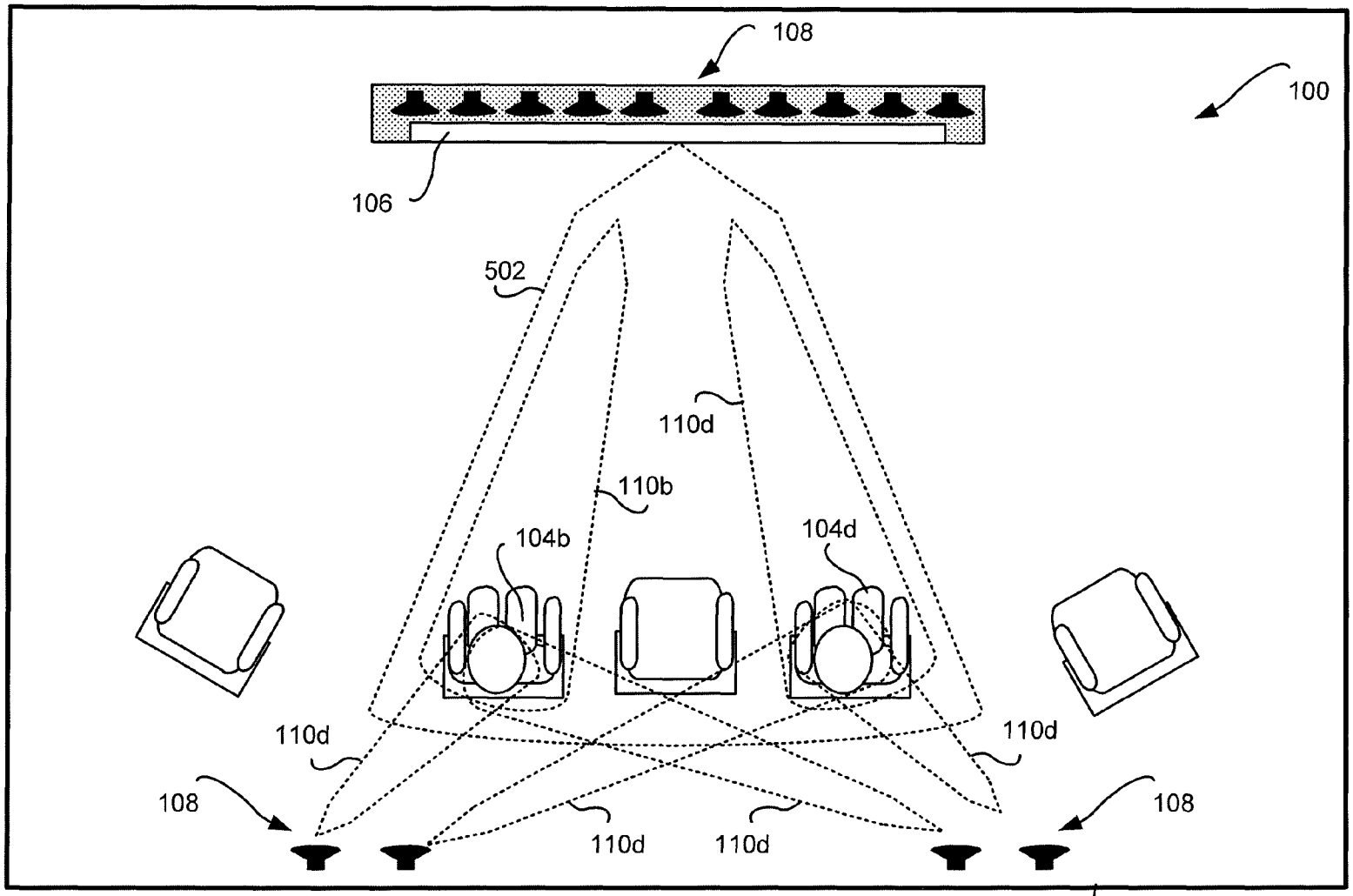
FIG. 5 conceptually illustrates an embodiment of the controllable high-fidelity sound system in a media room with respect to a plurality of users located in a common spot focused sound region.

FIG. 5 conceptually illustrates an embodiment of the controllable high-fidelity sound system 100 in a media room 102 with respect to a plurality of users 104*b*, 104*d* located in a common spot focused sound region 502. In this exemplary embodiment, the common spot focused sound region 502 is configured to provide controllable sound that is heard by a plurality of users 104*b* and 104*d* located in a common area in the media room 102. For example, the center channel of a 5.1 channel media content stream 120 may provide dialogue. One or more of the sound reproducing elements 108 may be located and oriented about the media room 102 so that the users 104*b* and 104*d*, for example, are hearing the dialogue in the common spot focused sound region 502. The configuration where multiple users hear the audio from a commonly generated spot focused sound region 110 may result in a reduced number of required sound reproducing elements 108 and/or in a less complicated audio channel control system.

In the various embodiments, each of the users 104 is able to control the audio characteristics of the particular one of the spot focused sound regions 110 that they are located in. In an exemplary embodiment, each user 104 has their own electronic device, such as the exemplary remote control 220, that communicates with the audio controller 116 using a wire-based, or a wireless based, communication medium. In some embodiments, the remote control 220 may have other functionality. For example, the remote control 220 may be configured to control the media content source 118 and/or the media presentation device, such as the exemplary television 206. Any suitable controller may be used by the various embodiments. Further, some embodiments may use controllers residing on the surface of the audio controller 116 to receive user inputs.

In some embodiments, the remote control 220 may allow multiple users to individually control their particular spot focused sound region 110. For example, the user may specify which of the particular one of the spot focused sound regions 110 that they wish to control. Alternatively, or additionally, a detector residing in the remote control 220 may provide information that is used by the audio controller 116 to determine the user location. Alternatively, or additionally, a map of the media room 102 may be presented on the sound setup GUI 224 that identifies defined ones of the spot focused sound regions 110, wherein the user 104 is able to operate the remote control 220 to navigate about the sound setup GUI 224 to select the particular one of the spot focused sound regions 110 and/or a particular sub-sound region, that they would like to adjust.

In some embodiments, the audio controller 116 is integrated with the media content source 118. For example, but not limited to, the media content source 118 may be a home entertainment system, or a component thereof, that performs a variety of different media entertainment functions. As another non-limiting example, the media content source 118 may be a set top box (STB) that is configured to receive media content from a broadcast system.

Any suitable sound reproducing element 108 may be employed by the various embodiments to produce the sounds of the audio channel 210 that is received from the audio controller 116. An exemplary sound reproducing element 108 is an magnetically driver cone-type audio speaker. Other types of sound reproducing elements 108 may include horn loudspeakers, piezoelectric speakers, magnetostrictive speakers, electrostatic loudspeakers, ribbon and planar loudspeakers, bending wave loudspeakers, flat panel loudspeakers, distributed mode loudspeakers, Heil air motion transducers, plasma arc loudspeakers, hypersonic sound speakers, and/or digital speakers. Any suitable sound reproducing device may be employed by the various embodiments. Further, embodiments may be configured to employ different types of sound reproducing elements 108.

Grouping of sound reproducing elements 108 may act in concert with each other to produced a desired acoustic effect. For example, but not limited to, group delay, active control, phase delay, phase change, phase shift, sound delay, sound filtering, sound focusing, sound equalization, and/or sound cancelling techniques may be employed to direct a generated spot focused sound region 110 to a desired location in the media room 102 and/or to present sound having desirable acoustic characteristics. Any suitable signal conditioning technique may be used, alone or in combination with other signal conditioning techniques, to condition the audio channels 210 prior to communication to the sound reproducing elements 108.

The sound reproducing element 108 may have a plurality of individual speakers that employ various signal conditioning technologies, such as an active crossover element or the like, so that the plurality of individual speakers may cooperatively operate based on a commonly received audio channel 210. One or more of the sound reproducing elements 108 may be a passive speaker. One or more of the sound reproducing elements 108 may be an active speaker with an amplifier or other signal conditioning element. Such speakers may be a general purpose speaker, such as a full range speaker. Other exemplary sound reproducing elements 108 may be specialized, such as tweeter speaker, a midrange speaker, a woofer speaker and/or a sub-woofer speaker.

The sound reproducing elements 108 may reside in a shared enclosure, may be grouped into a plurality of enclosures, and/or may have their own enclosure. The enclosures may optionally have specialized features, such as ports or the like, that enhance the acoustic performance of the sound reproducing element 108.

In an exemplary embodiment, the sound setup GUI 224 presents a graphical representation corresponding to the media room 102, the generated spot focused sound regions 110, the sound reproducing elements 108, and/or the seating locations of the users in the sweet spots of each generated spot focused sound region 110. For example, but not limited to, the sound setup GUI 224 may be substantially the same, or similar to, the exemplary illustrated embodiments of the controllable high-fidelity sound system 100 in the media room 102 of FIG. 1, FIG. 3, and/or FIG. 5.

In some embodiments, the controllable high-fidelity sound system 100 is configured to generate spot focused sound regions 110 based on different media content streams 202. For example, the exemplary television 206 having the display 106 may be configured to present multiple video portions of multiple media content streams 120. The video portions may be concurrently present on the display 106 using a picture in picture (PIP) format, a picture over picture (POP) format, a split screen format, or a tiled image format. Alternatively, or additionally, there may be multiple televisions 206 or other devices that are configured to present different video portions of multiple media content streams 120.

In such situations, the controllable high-fidelity sound system 100 generates a plurality of spot focused sound regions 110 for the different audio portions of the presented media content streams 202. Each of the presented media content streams 202 are associated with a particular user 104 and/or a particular location in the media room 102. Accordingly, each user 104 may listen to the audio portion of the particular one of the media content streams 202 that they are interested in viewing. Further, any user 104 may switch to the audio portion of different ones of the presented media content streams 202.

For example, the video portions of a football game and a movie may be concurrently presented on the display 106. A first user 104*b* may be more interested in hearing the audio portion of the football game. The controllable high-fidelity sound system 100 generates a spot focused sound region 110*b* such that the user 104*b* may listen to the football game. Concurrently, a second user 104*d* may be more interested in hearing the audio portion of the movie. The controllable high-fidelity sound system 100 generates a spot focused sound region 110*d* such that the user 104*d* may listen to the movie.

Further, in the event that the user 104*b* wishes to hear the audio portion of the movie, the user 104*b* may operate the controllable high-fidelity sound system 100 to change to presentation of the audio portion of the movie. Some embodiments of the controllable high-fidelity sound system 100 may be configured to store volume setting and other user specified acoustic characteristics such that, as the user 104*b* switches between presentation of the audio portion of the football game and the movie, the acoustic characteristics of the presented audio portions can be maintained at the settings specified by the user 104*b*.

It should be emphasized that the above-described embodiments of the controllable high-fidelity sound system 100 are merely possible examples of implementations of the invention. Many variations and modifications may be made to the above-described embodiments. All such modifications and variations are intended to be included herein within the scope of this disclosure and protected by the following claims.

The invention claimed is:

1. A method for synchronously presenting video and audio content to a plurality of users who are in a media room viewing the synchronously presented video and audio content, the method comprising:

receiving a media content stream comprising a video content stream portion and an audio content stream portion, wherein the audio content stream portion comprises at least a first audio channel and a second audio channel associated with the video content;

generating, from the video content stream portion, a video content stream comprising images for presentation on a display that is viewable by all of the plurality of users who are in the media room;

communicating the video content stream to the display, wherein the video content is presented on the display that is visible to the plurality of users that includes at least a first user and a second user;

processing the audio stream portion, wherein processing the audio stream portion comprises:

multiplying the first audio channel into a plurality of first audio channels;

multiplying the second audio channel into a plurality of second audio channels;

communicating a first one of the multiplied plurality of first audio channels and a first one of the multiplied plurality of second audio channels to a first audio sound region controller; and communicating a second one of the multiplied plurality of first audio channels and a second one of the multiplied plurality of second audio channels to a second audio sound region controller;

communicating a first audio signal from the first audio sound region controller to a first group of sound reproducing elements, wherein the first audio signal comprises the first one of the multiplied plurality of first audio channels and the first one of the multiplied plurality of second audio channels, wherein the first group of sound reproducing elements are each at a plurality of different locations about the media room, wherein a first sound reproducing element of the first group of sound reproducing elements is located in the media room at a position that is at a left side of the display, wherein a second sound reproducing element of the first group of sound reproducing elements is located in the media room at a position that is at a right side of the display, wherein the first sound reproducing element and the second sound reproducing element of the first group of sound reproducing elements are located in front of the first user, and wherein the first group of sound reproducing elements are each oriented towards a first spot focused sound region located in a first location of the media room where the first user is viewing and listening to the synchronously presented video and audio content, respectively;

communicating a second audio signal from the second audio sound region controller to a second group of sound reproducing elements, wherein the second audio signal comprises the second one of the multiplied plurality of first audio channels and the second one of the multiplied plurality of second audio channels, wherein the second group of sound reproducing elements are each at a plurality of different locations about the media room, wherein a first sound reproducing element of the second group of sound reproducing elements is located in the media room at a position that is at the left side of the display, wherein a second sound reproducing element of the second group of sound reproducing elements is located in the media room at a position that is at the fight side of the display, wherein the first sound reproducing element and the second sound reproducing element of the second group of sound reproducing elements are located in front of the second user, and wherein the second group of sound reproducing elements are each oriented towards a second spot focused sound region located in a second location of the media room where the second user is viewing and listening to the synchronously presented video and audio content, respectively;

receiving a first volume level specification from the first user that defines a first volume level;

receiving a second volume level specification from the second user that defines a second volume level;

uniquely controlling volume of the first audio signal in accordance with the first volume level so that only the first group of sound reproducing elements are controlled in accordance with the first volume level;

uniquely controlling volume of the second audio signal in accordance with the second volume level so that only the second group of sound reproducing elements are controlled in accordance with the second volume level;

emitting first sound at the first volume level from the first group of sound reproducing elements towards the first spot focused sound region in the media room where the first user is located, wherein the first sound is emitted based on the first audio signal received from the first audio sound region controller; and emitting second sound at the second volume level from the second group of sound reproducing elements towards the second spot focused sound region in the media room where the second user is located, wherein the second sound is emitted based on the second audio signal received from the second audio sound region controller, wherein the media room is presented with a plurality of sound reproducing elements arranged in a single straight line parallel to the display, wherein the first sound reproducing element and the second sound reproducing elements of the first group of the sound reproducing elements are selected from the plurality of sound reproducing elements in said straight line, wherein the first sound reproducing element and the second sound reproducing elements of the second group of the sound reproducing elements are selected from the plurality of sound reproducing elements in said straight line, wherein the first group of sound reproducing elements includes at least one sound reproducing element that is not in the second group of sound reproducing elements, and wherein the second group of sound reproducing elements includes at least one sound reproducing element that is not in the first group of sound reproducing elements.

2. The method of claim 1, further comprising:

conditioning at least one acoustic characteristic of the first one of the multiplied plurality of first audio channels and the first one of the multiplied plurality of second audio channels at the first audio sound region controller;

conditioning at least one acoustic characteristic of the second one of the multiplied plurality of first audio channels and the second one of the multiplied plurality of second audio channels at the second audio sound region controller;

communicating the conditioned first one of the multiplied plurality of first audio channels and the first one of the multiplied plurality of second audio channels from the first audio sound region controller to the first group of sound reproducing elements; and communicating the conditioned second one of the multiplied plurality of first audio channels and the second one of the multiplied plurality of second audio channels from the second audio sound region controller to the second group of sound reproducing elements.

3. The method of claim 2, further comprising:

emitting the first sound towards the first spot focused sound region in the media room, wherein the emitted first sound comprises the first audio channel emitted by the first sound reproducing element of the first group of sound reproducing elements, and corresponds to the second audio channel emitted by the second sound reproducing element of the first group of sound reproducing elements; and emitting the second sound towards the second spot focused sound region in the media room, wherein the emitted second sound comprises the first audio channel emitted by the first sound reproducing element of the second group of sound reproducing elements, and corresponds to the second audio channel emitted by the second sound reproducing element of the second group of sound reproducing elements, wherein the second location of the second spot focused sound region in the media room is different from the first location of the first spot focused sound region in the media room.

4. The method of claim 2, wherein the conditioning comprises:

adjusting volume of the first one of the plurality of first audio channels in accordance with the specified first volume level, wherein volume of the second one of the plurality of second audio channels is not adjusted in accordance with the specified first volume level; and adjusting volume of the first one of the plurality of second audio channels in accordance with the specified second volume level, wherein volume of the first one of the plurality of first audio channels is not adjusted in accordance with the specified second volume level.

5. The method of claim 2, wherein receiving the first volume level specification further comprises receiving a first user specification from the first user, wherein at least the first one of the plurality of first audio channels is further conditioned in accordance with the first user specification; and wherein receiving the second volume level specification further comprises receiving a second user specification from the second user, wherein at least the second one of the plurality of first audio channels is further conditioned in accordance with the second user specification.

6. An audio content presentation system that is configured to synchronously present video and audio content to a plurality of users who are at different locations in a media room viewing the synchronously presented video and audio content, comprising:

a display viewable by all of the plurality of users in the media room, wherein the video content is synchronously presented with the audio content so that the plurality of users view the video content on the display;

a channel separator configured to receive an audio content stream residing in a media content stream, wherein the received audio content stream is associated with a video content stream residing in the media content stream, wherein the channel separator is configured to separate a plurality of audio channels of the received audio content stream, and wherein the channel separator is configured to separately communicate the separated audio channels;

a plurality of channel multipliers configured to receive one of the separated audio channels from the channel separator, and wherein each channel multiplier is configured to multiply the received separated audio channel into a plurality of multiplied audio channels;

a user interface configured to receive at least user specification of a volume that each respective user specifies; and a plurality of audio sound region controllers configured to receive one of each of the multiplied audio channels from respective ones of the plurality of channel multipliers, wherein each audio sound region controller is configured to condition each of the multiplied audio channels received from respective ones of the plurality of channel multipliers into a plurality of conditioned audio channels, wherein each audio sound region controller is coupled to a plurality of sound reproducing elements that are unique members of a group of sound reproducing elements, wherein each of the sound reproducing elements of each unique group of sound reproducing elements are located at a plurality of different locations about the media room with a first one of each unique group of sound reproducing elements located in the media room at a position that is at a left side of the display and with a second one of each unique group of sound reproducing elements located in the media room at a position that is at a right side of the display, wherein each audio sound region controller communicates each of the plurality of conditioned audio channels to at least one different sound reproducing element of its respective unique group of sound reproducing elements in accordance only with the user specified volume from the user who is listening to that respective unique group of sound reproducing elements, wherein each of the sound reproducing elements of a particular group of sound reproducing elements are uniquely oriented towards one of a plurality of spot focused sound regions located in different locations about the media room where one of the plurality of users is viewing and listening to the synchronously presented video and audio content, respectively, wherein each of the sound reproducing elements of a particular group of sound reproducing elements emits sound towards its respective spot focused sound region in the media room based on the received conditioned audio channels and based only on the user specified volume from the user who is listening to that particular unique group of sound reproducing elements, wherein the media room is presented with a plurality of sound reproducing elements arranged in a single straight line parallel to the display;

wherein the first one and the second one of each unique group of sound reproducing elements are selected from the plurality of sound reproducing elements in said straight line, and wherein each unique group of sound reproducing elements include at least one sound reproducing element that is not in other unique group of sound reproducing elements.

7. The system of claim 6, further comprising:

a first group of sound reproducing elements communicatively coupled to a first one of the plurality of audio sound region controllers, wherein the first group of sound reproducing elements is configured to receive the respective conditioned audio channels from the first audio sound region controller, and wherein the first group of sound reproducing elements are configured to emit first sound towards a first spot focused sound region in the media room based upon the received conditioned audio channels; and a second group of sound reproducing elements communicatively coupled to a second one of the plurality of audio sound region controllers, wherein the second group of sound reproducing elements is configured to receive the respective conditioned audio channels from the second audio sound region controller, and wherein the second group of sound reproducing elements are configured to emit second sound towards a second spot focused sound region in the media room based upon the received conditioned audio channels, wherein a location of the first spot focused sound region in the media room is different from a location of the second spot focused sound region in the media room.

8. The system of claim 6, further comprising:

a user interface configured to receive a user specification that specifies conditioning performed on the conditioned audio channels.

9. The system of claim 6, further comprising:

a memory, wherein the channel separator, the channel multiplier, and the audio sound region controller are implemented as modules residing in the memory; and a processor system, wherein the processor system is configured to execute the channel separator module to separate the plurality of audio channels of the audio content stream, is configured to execute the channel multiplier module to multiply each of the received separated audio channels into a respective plurality of multiplied audio channels, and is configured to execute the audio sound region controller module to determine at least one audio characteristic for each of the received multiplied audio channels.

10. The system of claim 9, further comprising:

an audio channel controller, wherein the audio channel controller is configured to:

condition each of the received multiplied audio channels based upon the audio characteristic determined by the processor system;

communicate a first group of the conditioned audio channels to a first group of sound reproducing elements that emit first sound towards a first spot focused sound region in the media room; and communicate a second group of the conditioned audio channels to a second group of sound reproducing elements that emit second sound towards a second spot focused sound region in the media room, wherein a location of the first spot focused sound region is different from a location of the second spot focused sound region in the media room.

11. A method for presenting audio content, the method comprising:

receiving a media content stream comprising a video content stream and an audio content stream, wherein the audio content stream comprises a plurality of different audio channels associated with the video content stream;

multiplying a first channel of the different audio channels of the audio content stream into at least a first plurality of multiplied audio channels, where the first plurality of multiplied audio channels are the same;

multiplying a second channel of the different audio channels of the audio content stream into at least a second plurality of multiplied audio channels, wherein the second plurality of multiplied audio channels are the same;

grouping a first one of the first plurality of multiplied audio channels with a first one of the second plurality of multiplied audio channels into a first group of audio channels;

grouping a second one of the first plurality of multiplied audio channels with a second one of the second plurality of multiplied audio channels into a second group of audio channels;

conditioning the audio channels of the first group of audio channels into a first group of conditioned audio channels, wherein the conditioning is made in accordance with at least a first volume preference of a first user;

conditioning the audio channels of the second group of audio channels into a second group of conditioned audio channels, wherein the conditioning is made in accordance with at least a second volume preference of a second user;

receiving, at a first plurality of sound reproducing elements, the first group of conditioned audio channels, wherein the first group of conditioned audio channels correspond to the plurality of different audio channels of the audio content stream conditioned in accordance with the at least a first volume preference of the first user;

emitting first sound towards a first spot focused sound region in a media room, wherein the first sound is emitted from the first plurality of sound reproducing elements with at least one of the first plurality of sound reproducing elements located in front of the first user, wherein the first sound is emitted at a first volume level in accordance with only the first volume preference of the first user, and wherein the audio content stream is presented within the first spot focused sound region based upon the at least a first volume preference of the first user;

receiving, at a second plurality of sound reproducing elements, the second group of conditioned audio channels, wherein the second group of conditioned audio channels correspond to the plurality of different audio channels of the audio content stream conditioned in accordance with the a second volume preference of the second user;

emitting second sound towards a second spot focused sound region in the media room, wherein the second sound is emitted from the second plurality of sound reproducing elements with at least one of the second plurality of sound reproducing elements located in front of the second user, wherein the second sound is emitted at a second volume level in accordance with only the second volume preference of the second user, and wherein the audio content stream is presented within the second spot focused sound region based upon the at least a second volume preference of the second user, wherein a location of the first spot focused sound region in the media room is different from a location of the second spot focused sound region in the media room;

presenting the video content stream on a display that is visible to both the first user and the second user, wherein the first user hears the audio content stream based upon his/her preferences while the second user concurrently hears the audio content stream based upon his/her preferences, and wherein both the first user and the second user view the video content on the display;

wherein the media room is presented with a plurality of sound reproducing elements arranged in a single straight line parallel to the display;

wherein said at least one of the first plurality of sound reproducing element is selected from the plurality of sound reproducing elements in said straight line;

wherein said at least one of the second plurality of sound reproducing element is selected from the plurality of sound reproducing elements in said straight line;

wherein said first plurality of sound reproducing elements includes at least one sound reproducing element that is not in said second plurality of sound reproducing elements; and wherein said second plurality of sound reproducing elements includes at least one sound reproducing element that is not in said first plurality of sound reproducing elements.

12. The method of claim 11, further comprising:

receiving a user specification corresponding to the at least one preference of the first user;

conditioning at least one acoustic characteristic of at least one of the first plurality of multiplied audio channels based upon the user specification;

generating the first group of conditioned audio channels based upon the at least one of the first plurality of multiplied audio channels; and communicating the generated first group of conditioned audio channels to the first plurality of sound reproducing elements.

13. The method of claim 11, further comprising:

receiving a first user specification of the first volume level of the first sound emitted towards the first spot focused sound region;

adjusting volume of the first sound in accordance with the specified first volume level;

receiving a second user specification of the second volume level of the second sound emitted towards the second spot focused sound region; and adjusting volume of the second sound in accordance with the specified second volume level.

14. The method of claim 13, wherein the audio content stream comprises an automatic volume adjustment, and further comprising:

readjusting volume of the first sound in accordance with the specified first volume level and the automatic volume adjustment; and readjusting volume of the second sound in accordance with the specified second volume level and the automatic volume adjustment.

* * * * *